United States Patent [19]

Irwin

[11] 4,000,043

[45] Dec. 28, 1976

[54] COKE OVEN DOOR JAMB CLEANING TOOL

[75] Inventor: Rodney C. Irwin, Pittsburgh, Pa.

[73] Assignee: Koppers Company, Inc., Pittsburgh, Pa.

[22] Filed: June 21, 1976

[21] Appl. No.: 698,173

[52] U.S. Cl. ..... 202/241; 15/93 A

[51] Int. Cl.[2] ..... C10B 43/04

[58] Field of Search ..... 202/241; 15/93 A, 246.5; 201/2

[56] References Cited

UNITED STATES PATENTS

| | | | |
|---|---|---|---|
| 3,696,004 | 10/1972 | McCullough | 202/241 |
| 3,758,910 | 9/1973 | Lakeberg | 202/241 X |
| 3,955,232 | 5/1976 | Konno | 202/241 X |
| 3,971,092 | 7/1976 | Stanke et al. | 202/241 X |

*Primary Examiner*—R.E. Serwin
*Assistant Examiner*—Roger F. Phillips
*Attorney, Agent, or Firm*—Sherman H. Barber; Oscar B. Brumback

[57] ABSTRACT

A cleaning tool for door jamb surfaces of a coke oven chamber includes: a sleeve fixed to a frame that is movable toward the door jamb; a plunger resiliently mounted in the sleeve; a support fixed to the plunger; and a multi-sided scraper tool rotatably mounted to the support. Two such cleaning tools may be used to clean the inside and the outside door jamb surfaces.

4 Claims, 6 Drawing Figures

COKE OVEN DOOR JAMB CLEANING TOOL

BACKGROUND OF THE INVENTION

The present invention relates to coke ovens generally and, more particularly, to a tool for cleaning door jamb surfaces.

One of the problems encountered in operating a modern coke oven battery is sealing of the doors at each end of each coke oven chamber. The doors must be removed and replaced each time coke is pushed from an oven chamber, and it has been found to be necessary to clean both the sealing edge on the coke oven doors after they have been removed, and the door jambs against which the sealing edge presses.

Also, it has been found to be necessary to clean the opposed vertical side and the opposed horizontal top and bottom door jamb surfaces that stand adjacent to the sealing surfaces that coact with the knife edge on the door.

Heretofore in the prior art, such opposed vertical side and opposed horizontal top and bottom surfaces of the door jamb have been cleaned, in one instance, by a blade scraper, as shown and described hereinafter. But, such prior art scraper device has not functioned entirely satisfactorily. In some instances, the prior art scraper has malfunctioned so badly that the door jamb could not be cleaned on that push of coke.

The present invention, however, overcomes the difficulty experienced in using the prior art type of door jamb cleaner and such malfunctioning does not occur.

SUMMARY OF THE INVENTION

A cleaner apparatus for a door jamb of a coke oven battery includes a frame that is reciprocable vertically and tools are mounted to the frame that coact with and clean the door jamb. The tools are multi-sided and may typically be hexagonal in shape and are mounted resiliently. They are rotatable about a vertical axis with one of the multi-sides of the tool coacting with a surface of the door jamb to be cleaned. A plurality of the multi-sided tools are so mounted to clean the surface of the door jamb that requires cleaning.

For a further understanding of the invention and for features and advantages thereof, reference may be made to the following description and the drawings which illustrate a preferred embodiment of equipment in accordance with the invention.

DETAILED DESCRIPTION

Figure 1:
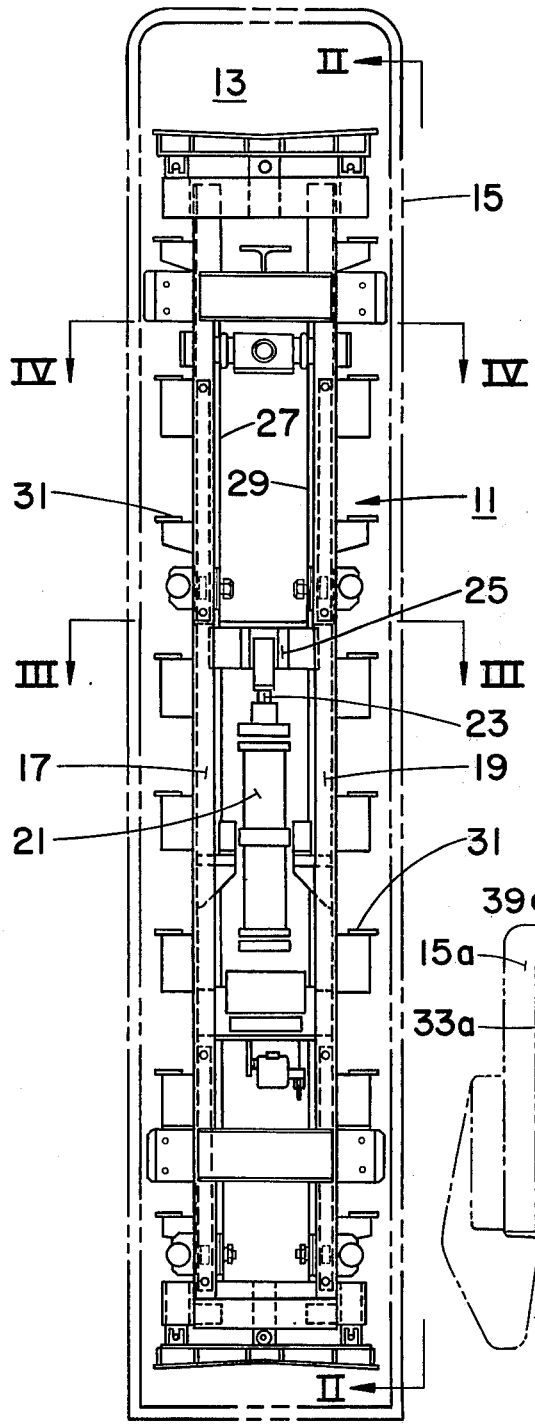
FIG. 1 is a schematic front elevational view of a coke oven door jamb cleaner head.
Figure 2:
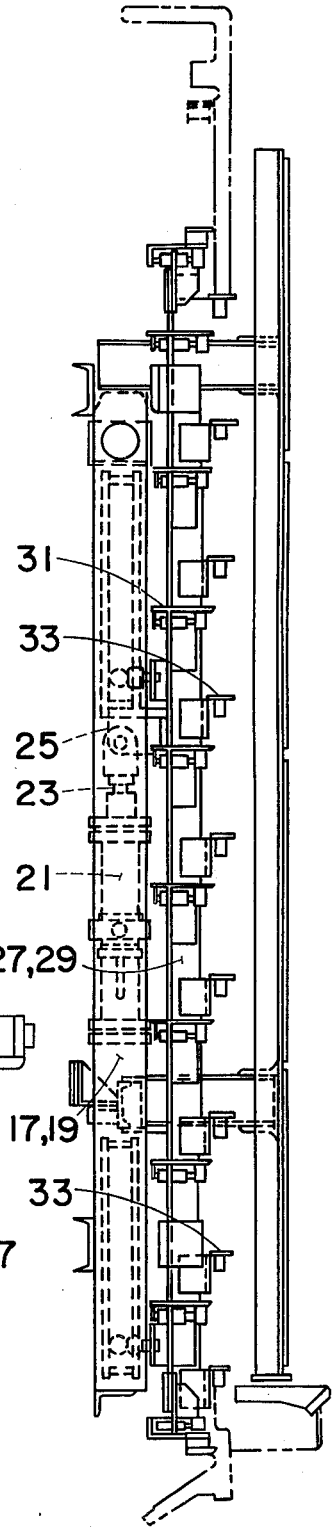
FIG. 2 is a view along line II—II of FIG. 1.

Referring to FIGS. 1 and 2, a coke oven door jamb cleaner head assembly 11 is shown in an operative position at an open coke oven chamber 13 from which the coke oven door has been removed. Shown in outline is the coke oven door jamb 15.

Figure 3:
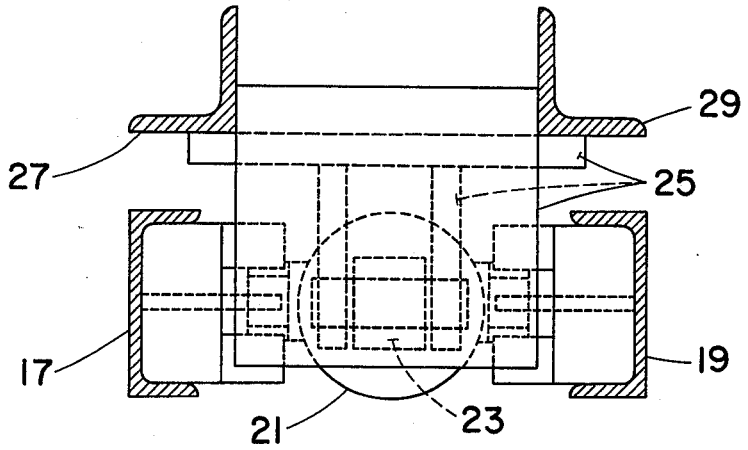
FIG. 3 is a view along line III—III of FIG. 1.

The jamb cleaner head assembly 11 is conventional in construction and includes a support frame comprising spaced apart, vertically oriented structural channels 17, 19. The channels 17, 19 support a cylinder-piston assembly 21 having a piston rod 23 that is pivotally secured to plate structure 25. The plate structure 25 (FIG. 3) is secured, as by welding, to a pair of spaced-apart, vertically oriented angles 27, 29.

Figure 5:
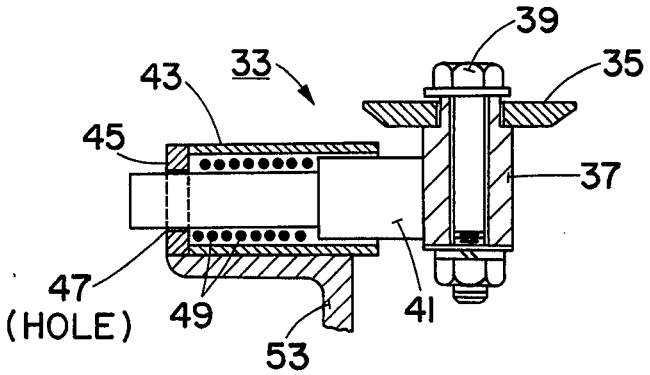
FIG. 5 is a view along line V—V of FIG. 4 and shows a sectional elevational view of a multi-sided tool in accordance with the invention.

The angles 27, 29 carry a plurality of spaced-apart conventional first door jamb cleaners 31 of the blade scraper type, and a plurality of spaced-apart second inside door jamb cleaners 33 in accordance with the present invention (FIG. 5).

Figure 4:
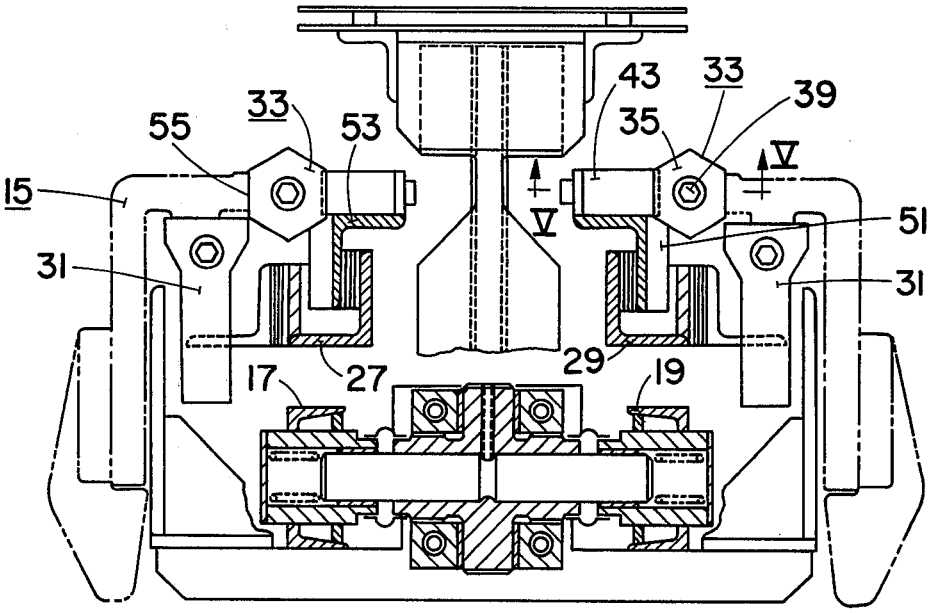
FIG. 4 is a view along line IV—IV of FIG. 1.

The door jamb cleaner 33 shown in FIGS. 4 and 5 comprises typically a multi-sided or hexagonal-shaped scraper 35 that is freely, rotatably, mounted to a bushing 37. The scraper 35 is held thereon by a bolt-nut-lock washer assembly 39. The bushing 39 is fixed, as by welding, to one end of a plunger 41 that is fitted into a sleeve 43. The sleeve 43 is closed at one end by an end cap 45 having a hole 47 therein through which an extending portion of the plunger 41 protrudes. Within the sleeve 43 there is a compression-type spring 49 that urges the plunger outwardly of the sleeve 43.

The sleeve 43 is secured, as by welding, to an angle 53 carried by the angle 27, on the left-hand side of the cleaner head assembly 11, or an angle 29 on the right-hand side thereof, as viewed in FIGS. 1 and 4.

Heretofore, the tools used to clean the inside surfaces of a coke oven door jamb, such as the inside surfaces 55 of the jamb 15, shown in FIGS. 1 and 4, have been blade-type scrapers shaped very much like the scraper tools 31. Such inside blade-type scrapers like 31 were not adjustable so that when the door jamb cleaner head assembly was moved toward the door jamb for cleaning, the inside surface, blade-type cleaning tools very frequently were either bent or broke away from their support.

The inside jamb surface cleaning tools 33 of the present invention overcome the deficiency of such prior art cleaning tools in this way: when the cleaning tool 33 makes first contact with the corner, between the inside and the outside jamb surfaces, the cleaning tool 33 either slides into contact relation with the inside jamb surface 55, or rotates about the vertical axis of the bushing until one of the multi scraper edges of the multi-sided cleaner tool 35 contacts the surface 55. The multi-sided scraper tool 35 then rotates as the entire cleaner head assembly 11 is moved into final position.

Figure 6:
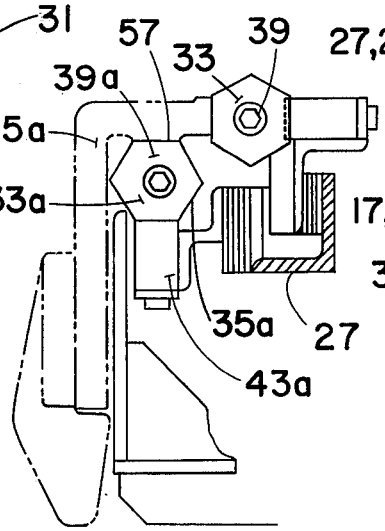
FIG. 6 is a schematic plan view of a portion of a door jamb showing two multi-sided door jamb cleaning tools in accordance with the present invention.

FIG. 6 illustrates a door jamb 15*a* that is conventional and in all respects similar to the door jamb 15 shown in FIGS. 1 and 4. In FIG. 6, however, the conventional door jamb cleaner 31 of the blade-type scraper, shown in FIG. 4, is replaced by a multi-sided door jamb cleaner 33*a* that is substantially like the inside door jamb cleaner 33, shown in FIGS. 4 and 5 and described in detail herein. The door jamb cleaner 33*a* is mounted to the angles 27, 29, as are the door jamb cleaners 33, and includes typically a hexagonal-shaped cleaning tool 35*a* that is resiliently mounted, as is the typical hexagonal cleaning tool 33, in a sleeve 43*a*. The hexagonal-shaped cleaning tool 35*a* is also rotatable about a vertical axis in fastener 39*a* and coacts with a surface 57 of the door jamb 15*a*.

From the foregoing description of one embodiment of the invention, those skilled in the art should recognize many important features and advantages of it, among which the following are particularly significant:

That the multi-sided jamb cleaner tools are free to rotate as necessary and to thereby avoid the tendency of prior art inside jamb cleaner tools to bend or break off;

That the multi-sided inside jamb cleaner tool particularly is free to rotate and will not prevent the easy removal of the tool when the jamb cleaner head is retracted after the entire door jamb is cleaned;

That the jamb cleaner tools may have typically, if hexagonal shaped, six cleaning or scraping edges; thereby prolonging the useful life of the cleaner tool; and That the cost to replace the rotatable multi-sided jamb cleaner tools is minimal compared to the cost to replace a bent or broken tool of the prior art.

Although the invention has been described herein with a certain degree of particularity it is understood that the present disclosure has been made only as an example and that the scope of the invention is defined by what is hereinafter claimed.

What is claimed is:

1. In a cleaner apparatus for a door jamb of a coke oven battery, said apparatus including a frame that is reciprocable vertically when placed in juxtaposition with said coke oven door jamb whereby tools mounted in spaced-apart relation to said frame coact with and clean surfaces of said door jamb as said frame reciprocates, the improvement in said cleaner apparatus comprising:

a. a multi-sided cleaning tool mounted resiliently to said frame and mounted for rotation about a vertical axis, with one of the multi sides of said cleaning tool contacting a surface of said door jamb to be cleaned.

2. The invention of claim 1 including:

a. a second multi-sided cleaning tool mounted resiliently to said frame and disposed angularly with respect to said at least one tool, and with at least one side of said second multi-sided cleaning tool coacting with a second surface of said door jamb to be cleaned; said second tool being mounted for rotation about a vertical axis.

3. The invention of claim 1 wherein:

a. Said multi-sided cleaning tool is a hexagonal-shaped tool rotatably mounted on a plunger slidably disposed in a sleeve fixed to said frame with resilient means in said sleeve urging said plunger outwardly and said tool in a direction toward said door jamb surface to be cleaned.

4. A tool adapted for cleaning surfaces of a door jamb of a coke oven chamber comprising:

a. a sleeve;

b. a plunger resiliently mounted in said sleeve;

c. a support secured to a portion of said plunger extending from said sleeve; and d. a multi-sided cleaning tool rotatably mounted to said support in such a way that one side of said multi-sided tool is disposed to contact said door jamb surfaces.

* * * * *